US006022249A

United States Patent [19]

Ketterman

[11] Patent Number: 6,022,249

[45] Date of Patent: Feb. 8, 2000

[54] WATERCRAFT

[75] Inventor: Gregory S. Ketterman, Encinitas, Calif.

[73] Assignee: R.R. Sail Inc., Oceanside, Calif.

[21] Appl. No.: 08/903,020

[22] Filed: Jul. 30, 1997

[51] Int. Cl.[7] ..... B63H 1/30

[52] U.S. Cl. ..... 440/13; 400/21

[58] Field of Search ..... 440/13, 21, 22, 440/25, 27, 30, 102

[56] References Cited

U.S. PATENT DOCUMENTS

| | | | |
|---|---|---|---|
| 2,286,914 | 6/1942 | Knapp | 440/13 |
| 2,873,713 | 2/1959 | Baastrup | 440/21 |
| 2,948,255 | 8/1960 | Sbrana | 440/21 |
| 4,936,802 | 6/1990 | Ueno | 440/13 |
| 5,460,551 | 10/1995 | Beres | 440/27 |

FOREIGN PATENT DOCUMENTS

| | | | |
|---|---|---|---|
| 452719 | 8/1936 | United Kingdom | 440/13 |

*Primary Examiner*—Stephen Avila
*Attorney, Agent, or Firm*—Joseph E. Mueth, Esq.

[57] ABSTRACT

A novel water craft, which may include a hull with a keel, having propulsion means extending below the water line. The propulsion means comprises a pair of flappers each adapted to oscillate through an arcuate path in a generally transverse direction with respect to the central longitudinal dimension of the watercraft. Means are operatively associated with the propulsion means for applying input force to the propulsion means. The flappers twist to form an angle of attack for providing forward thrust with respect to the longitudinal dimension of the watercraft while moving in both directions along the arcuate path.

21 Claims, 6 Drawing Sheets

FIG. 3.
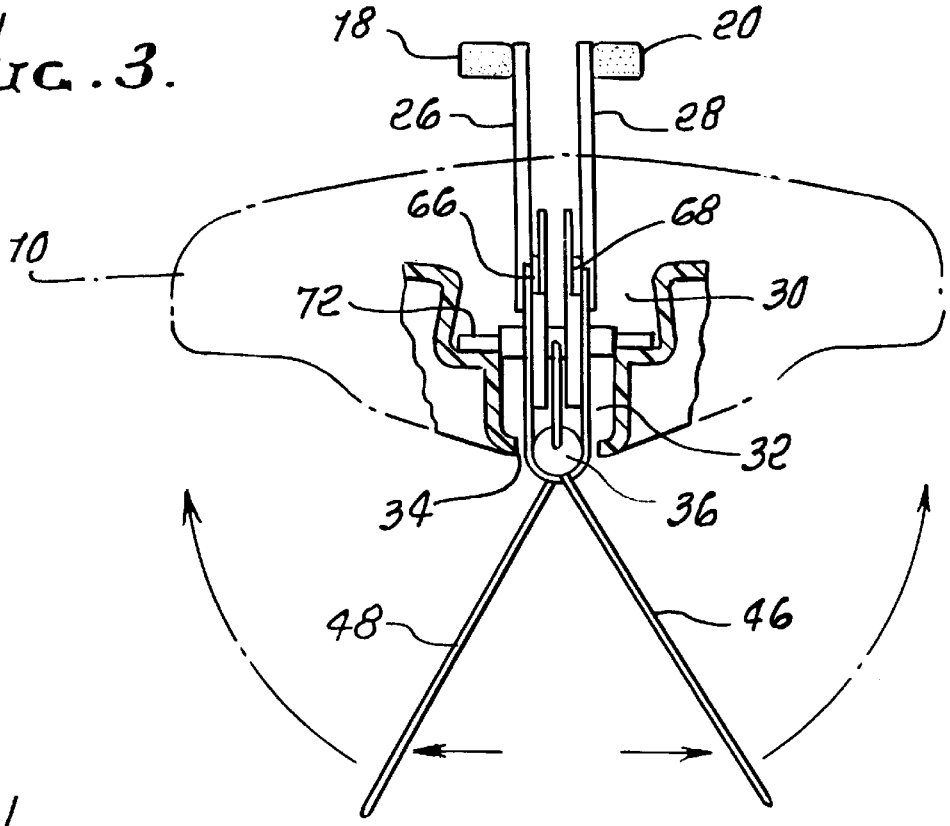
FIG. 7.
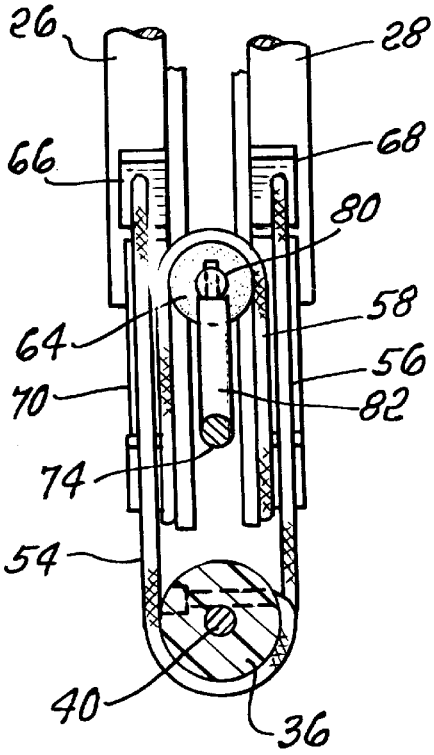
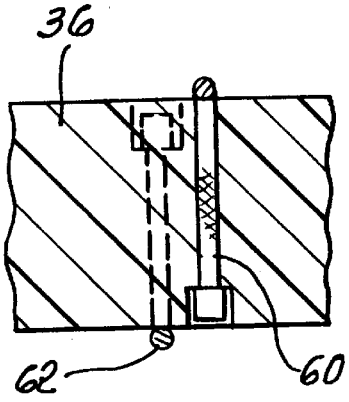
FIG. 6.

7
7
5
5
26
76
66
70
64
80
58
82
54
36
42
56
46
50
40
44
48
62
52
38
34
74
60
84
72
78

WATERCRAFT

FIELD OF INVENTION

This invention relates to novel propulsion means for water craft.

BACKGROUND OF INVENTION

Various pedal operated means for propelling boats, kayaks & other watercraft have been proposed. For example, Kiker U.S. Pat. No. 3,032,001 describes a pedal operated boat propulsion apparatus; Price U.S. Pat. No. 4,318,700 relates to a paddle wheel operated watercraft having pedals to be engaged by the feet of a seated occupant; Daoud U.S. Pat. No. 4,474,502 shows a surfboard having handle bar, passenger seat and pedal, much like a bicycle, with propulsion being provided through a gear train to a rotary propeller; Fanelli U.S. Pat. No. 4,511,338 pertains to a detachable device for converting a said board into a water bicycle; Guiboche U.S. Pat. No. 5,183,422 discloses a pedal boat having a belt-driven paddle wheel; Shiracki U.S. Pat. No. 5,194,024 discloses a propeller driven surfboard; Gagnier U.S. Pat. No. 5,453,031 pertains to a propulsion device for a paddle boat; and Beres U.S. Pat. No. 5,460,551 relates to a pedal powered kayak wherein rotatable pedals are connected via a linkage to a propeller.

Stolzer U.S. Pat. No. 3,095,850 describes a foot operated paddle boat wherein the paddle is transversely sculled or twisted across the bow of the boat, the pitch of the paddle being reversed at each reversal of path direction to provide propulsion force in both directions of paddle travel. Stolzer U.S. Pat. No. 4,960,396 relates to a modification in which a rigid planar paddle blade is used. The devices are limited in the propulsive force which they provide.

The Boston Globe, May 13, 1997, reports on a mechanically powered propulsion system for ships undergoing development at Massachusetts Institute Of Technology which employs as the ultimate propulsion means a pair of flappers said to mimic the flapper motion of a penguin described as being like holding ones arms straight down with the hands open, then bringing the arms together in a clapping motion while rotating one's hands. The system includes four different motors to produce the flapping and twisting functions, all guided by a computer and complex circuiting.

SUMMARY OF INVENTION

The invention includes:

(1) A novel water craft having propulsion means extending below the water line comprising a pair of flappers each adapted to oscillate through an arcuate path in a generally transverse direction with respect to the central longitudinal dimension of said watercraft, and means operatively associated with said propulsion means for applying input force to said propulsion means.

(2) A novel device adapted to be placed in a watercraft, said device including propulsion means extending below the water line comprising a pair of flappers each adapted to oscillate through an arcuate path in a generally transverse direction with respect to the central longitudinal dimension of said watercraft, and means operatively associated with said propulsion means for applying input force to said propulsion means.

(3) A novel water craft including a hull with a keel and having propulsion means extending below said keel comprising a pair of flappers each adapted to oscillate through an arcuate path in a generally transverse direction with respect to the central longitudinal dimension of said hull, and means within said hull operatively associated with said propulsion means for applying input force to said propulsion means.

(4) The invention further comprehends a novel device adapted to be placed into a water craft having a hull and keel, said device including propulsion means adapted to be partially received in a compartment in said hull and to extend below said keel comprising a pair of flappers each adapted to oscillate through an arcuate path in a generally transverse direction with respect to the central longitudinal dimension of said hull, and means operatively associated with said propulsion means for applying input force to said propulsion means.

Preferably, the means for applying propulsive force includes pedals to which human footpower can be applied. The use of human power or a combination of hand and foot power is also included.

In the preferred embodiments, the flappers are adapted to simultaneously reverse direction at opposite ends of the arcuate path.

This invention is applicable to watercraft generally, including kayaks, boats, catamarans, and the like. The watercraft may, but not necessarily, include a hull having a keel.

DESCRIPTION OF PREFERRED EMBODIMENTS

Turning to the drawings:

FIG. 3 is a section taken along line 3—3 in FIG. 1.

FIG. 6 is a section taken along the line 6—6 in FIG. 5.

FIG. 7 is a section taken along line 7—7 in FIG. 4.

Figure 1:
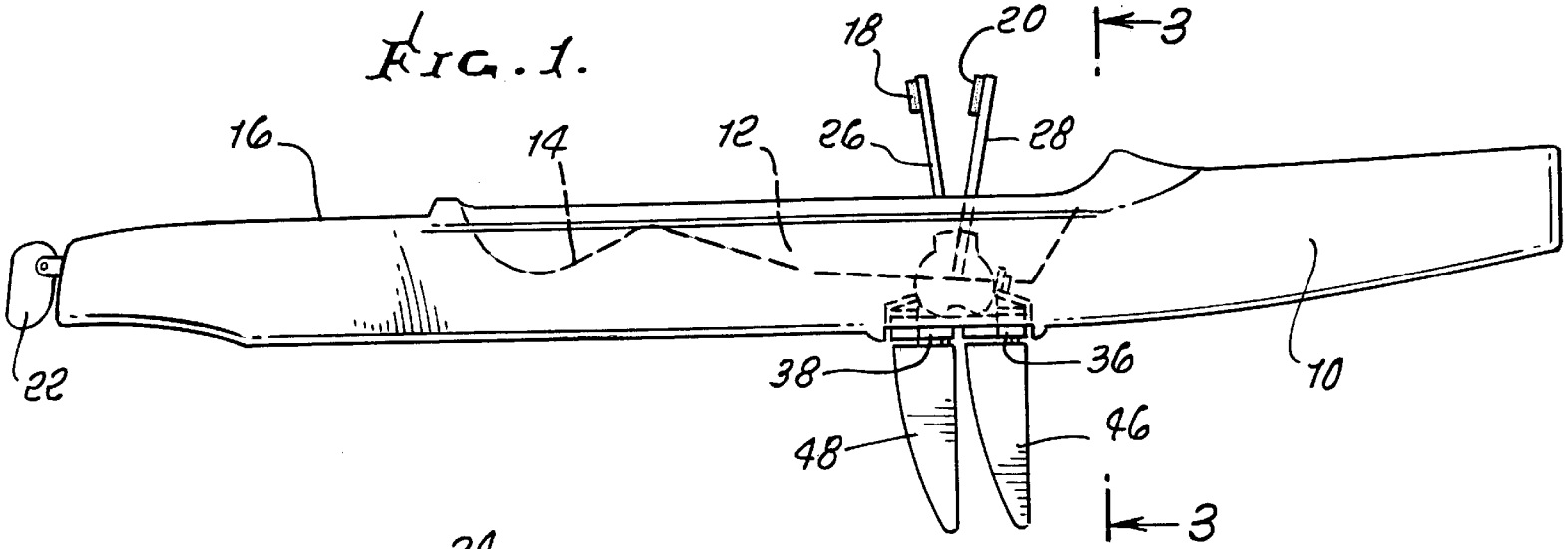
FIG. 1 is a side view of a kayak equipped with the device of the present invention.
Figure 2:
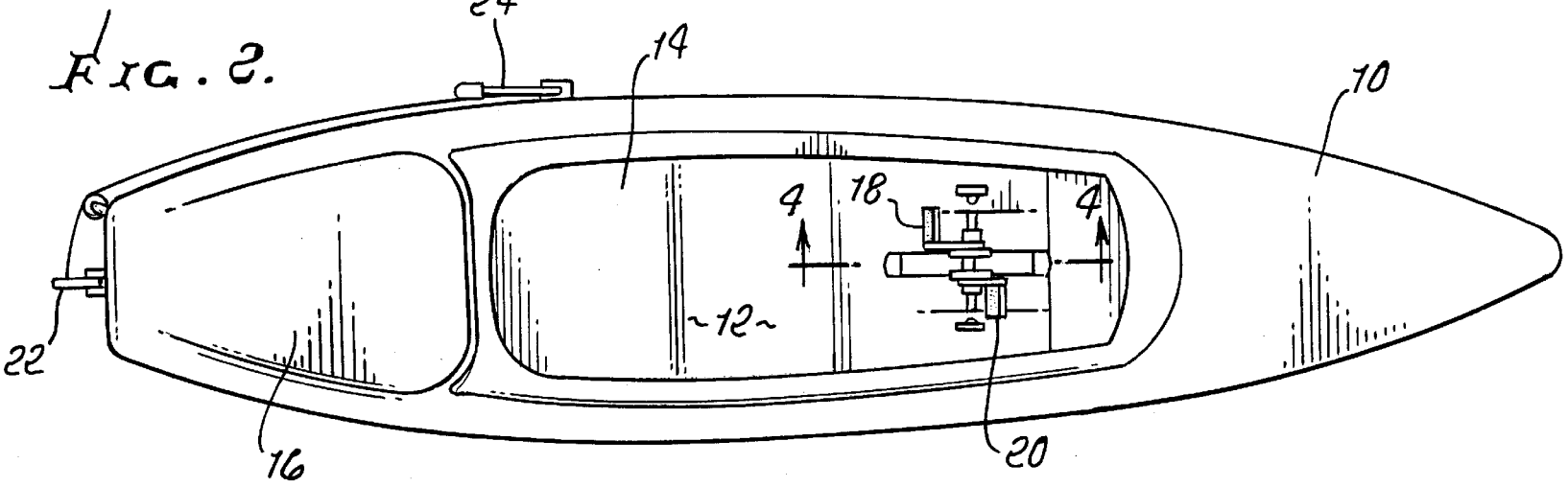
FIG. 2 is a top view of the kayak of FIG. 1.
Figure 4:
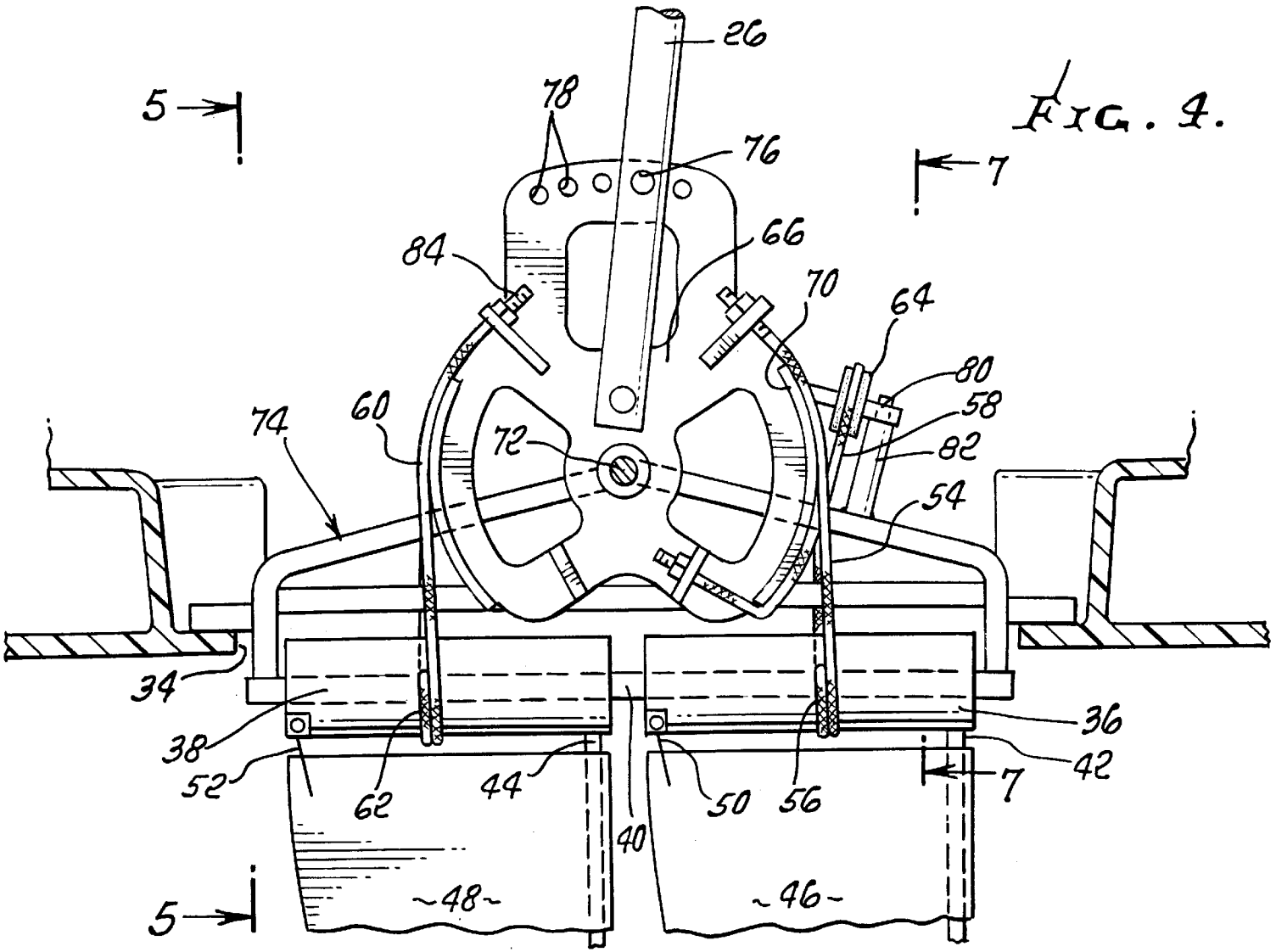
FIG. 4 is a Section taken along line 4—4 in FIG. 2.
Figure 5:
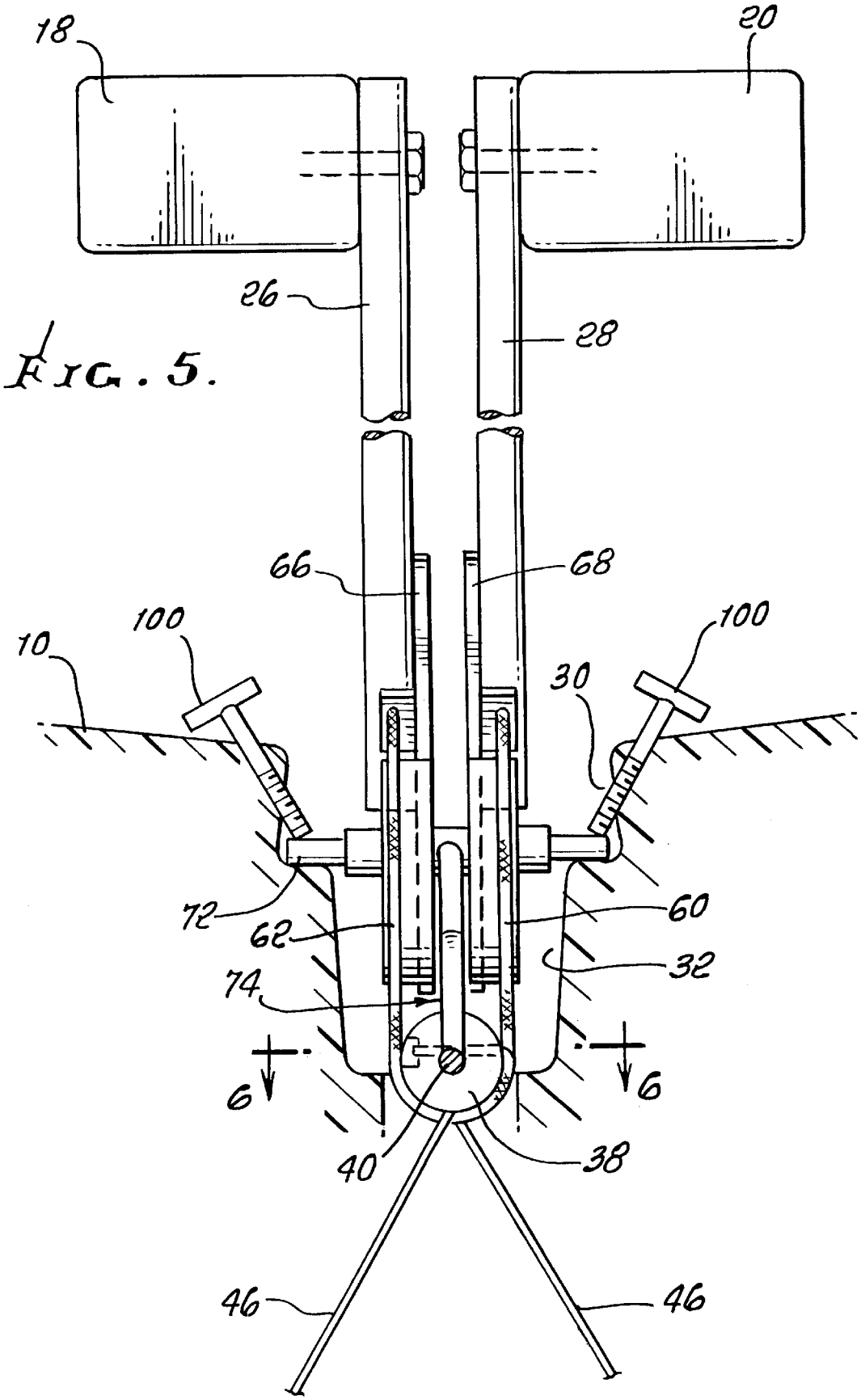
FIG. 5 is a section taken along the line 5—5 in FIG. 4.

One preferred embodiment is a pedaled kayak propelled by the "penguin" like action of two transversely oscillating flappers or sails. As the force on the pedals is increased, the less restrained end of the flapper or sail twists to assume a propeller like shape. As the flappers or sails oscillate, they change pitch or shape upon reaching the end of their arcuate movement, viz, when they simultaneously reverse direction of movement at the opposite ends of their arcuate pathway. This sail action is somewhat similar to what happens when tacking in a sailboat in that the sails exert, in both of their directions of movement, a forward thrust component.

Turning to the drawings in more detail, the drawings illustrate an embodiment of the invention in the form of a kayak having a generally elongated hull 10 made, for example, by rotomolding from a plastic such as polyethylene. The cockpit 12 has a seat 14 located such that the hip of the user is substantially fully below the upper deck 16 of the kayak. The cockpit 12 also contains a set of pedals 18 and 20 adapted to be pushed, first one and then the other, by the user's feet. The hull 10 is also provided with a rudder 22 and tiller 24.

The pedals 18 & 20 are operatively connected by pedal shafts 26 and 28, respectively, to the propulsion means which extends upwardly through two vertically disposed compartments 30 and 32 in the center of the bottom of hull 10, the upper compartment 30 being somewhat larger than the lower compartment 32. The bottom of the lower compartment 32 has an opening 34.

The drums 36 and 38 are rotatable about the fixed longitudinal steel shaft 40 which is carried in the lower compartment 32.

The rotatable drums 36 and 38 carry radially extending rigid masts 42 and 44, respectively. The masts project in a generally downwardly direction so that they always remain in the water and do not contact the underside of the hull. The masts support the sails or flappers 46 and 48, respectively, at their leading edges. Each of the sails is rotatable about its mast, so that the edge of the flapper opposite the leading edge can move from one side to the other with respect to the longitudinal center line of drums 36 and 38. This action results in both flappers exerting of forward force or push on the watercraft in both directions of transverse movement of the flappers, providing superior efficiency and speed. The extent of travel or movement of the trailing edges is limited by the adjustment provided by main sheet tensioners 50 and 52.

The sail or flapper support arm (mast) 42 is attached to the front of front drum and second Sail or Flapper support arm 44 is attached to the front of rear drum 38. At the rear of each sail or flapper, the main sheet tensioner connects to its respective drum and is adjustable in its reach or length to alter the tension in each of the sails or flappers 46 and 48.

The two drums 36 and 38 are normally in the water. The drums 36 and 38 are preferably made of an engineered plastic such as Delron. When the drums 36 and 38 rotate on the fixed longitudinal steel shaft 40, the inside of the Delron drums and the outside of the steel shaft form a bearing.

Typically, when the two sail or flapper support arms (masts) 42 and 44 are in the same plane with each other, the pedal shafts 26 and 28 are in the same plane with each other, although, of course, these two planes are perpendicular to each other. Perpendicularity is not important to the function of the invention.

FIGS. 1 to 7 show the most preferred embodiment of the means for providing propulsive force where cable connections are used exclusively. This embodiment has a total of five cables, three cables, 54, 56 & 58, at the front (front being in the direction of the bow of the kayak), and two cables, 60 and 62, at the back. The small pulley, 64, which is at the front with its cable 58 helps reduce excessive tension on the two rear cables.

Except for the cable 58 running over the small pulley, 64, the other 4 cables each run from one of the metal upper members, referred to as pedal support and cable guides, 66 and 68, each of which carry a pedal shaft, 26 and 28, to one of the Delron drums 36 or 38. Thus, two cables 54 and 60 run from one metal pedal support and cable guide 66 to front and rear Delron drums, 36 and 38, respectively. The other two cables 56 and 62 run from the second upper pedal support and cable guide 68 to the Delron drums 36 and 38. These cables have swaged ends which are countersunk into the Delron drums 36 and 38, as shown in FIG. 6. The flanges 70 on the pedal support and cable guides, 66 and 68, act as cable restrainers and serve to keep the cables in place over the guides.

The pedals and their shafts 26 and 28 are connected to pedal support and cable guides 66 and 68. The pedal support and cable guides 66 and 68 have Delron inserts so that pedal shafts and pedal support and cable guides can rotate back and forth on stationary transverse or cross shaft 72 which is fixably welded to the upper part of the coat hanger shaped support structure 74, the lower part of said support structure 74 carrying the longitudinal shaft 40, which, in turn, carries the two Delron drums 36 and 38 to which the sail or flapper arms (masts) are attached.

The holes 76 on each pedal shaft are provided with slidable pins which can be pulled in and out of the holes 78 which are arrayed across top of each of the metal pedal support and cable guides 66 and 68 to adjust for and accommodate different human leg lengths. This provides a very simple and effective adjustment mechanism to allow for different lengths of the human body. The pedals can be pinned in one of 5 locations to make adjustments.

The small front pulley rotates 64 on fixed shaft 80 which shaft is held by uprights 82 welded to the coat hanger shaped support structure 74 with screws. The small front pulley 64 preferably is polyethylene but Delron can be used. The nylon washers act as spacers to keep front pulley 64 in position.

Several cable systems can be used. A system which allows all four cables 54, 56, 60 and 62 to be adjusted independently by tightening or loosening of threaded ends 84 seems to work the best. Tuning the exact amount of flapper and pedal travel, and the size and stiffness of the flappers is a function of the watercraft characteristics and can be carried out by those skilled in the art.

Figure 8:
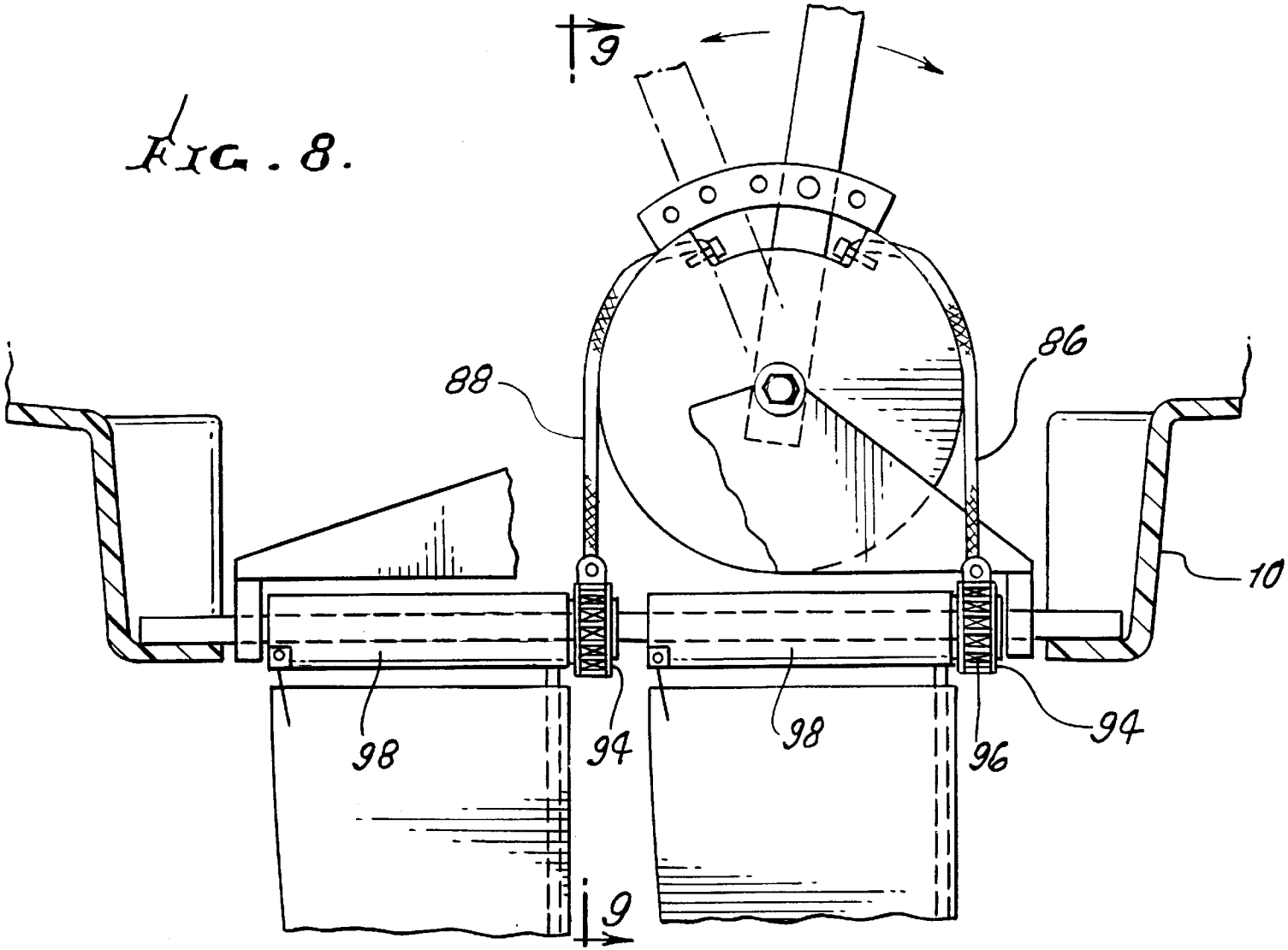
FIG. 8 is a partial sectional, similar in location to FIG. 4, of an alternate embodiment of this invention.
Figure 9:
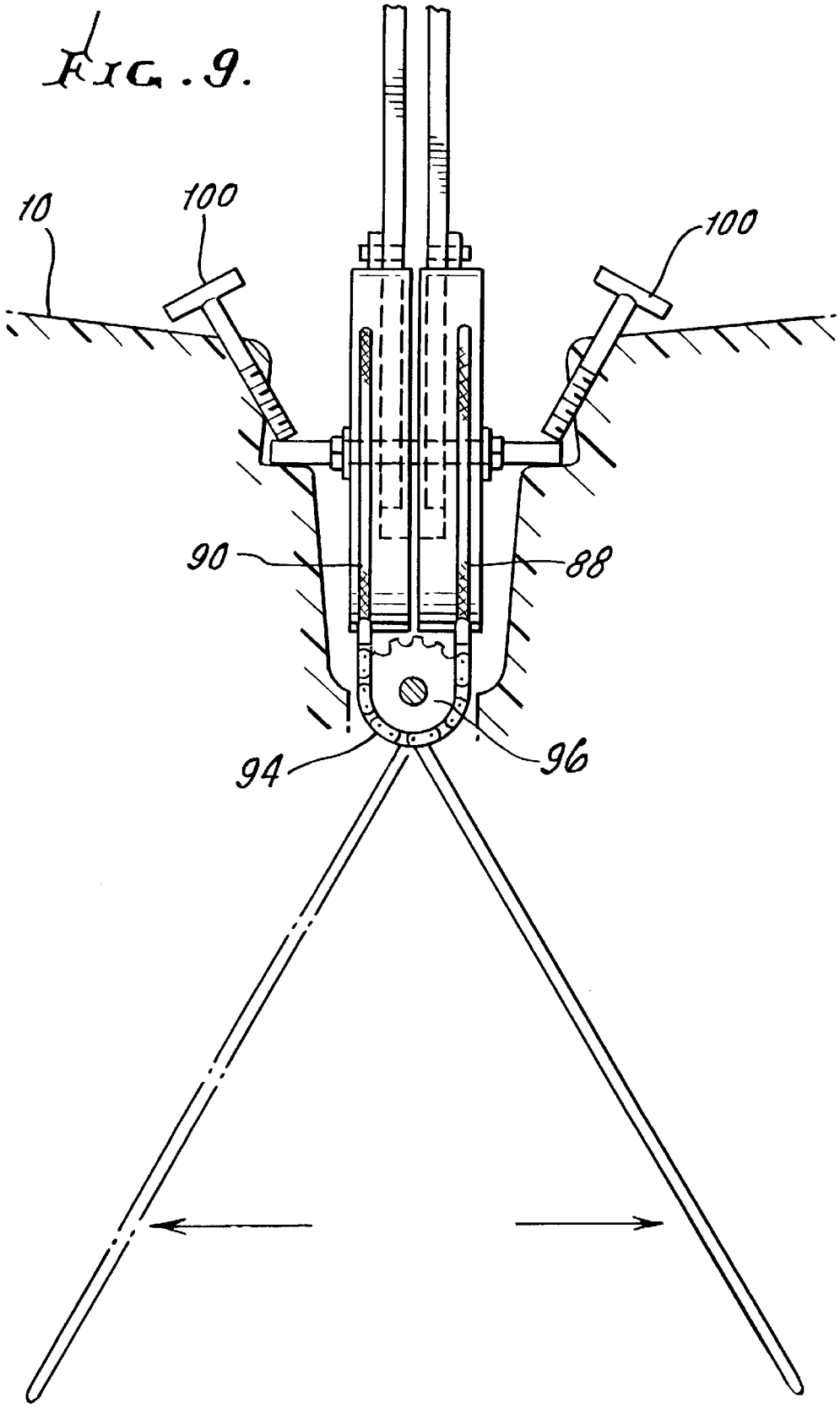
FIG. 9 is a section taken along line 9—9 in FIG. 8.

FIGS. 8 and 9 show an alternate embodiment in which there is no front pulley and hence just 4 cables, three of which 86, 88, and 90, can be seen in FIGS. 8 and 9. These cables are connected to chains 94 which run over sprockets 96 and turn the metal drums (instead of Delron) 98. Except as noted, the embodiment of FIGS. 8 and 9 is the same in construction and operation as the first embodiment discussed hereinabove with respect to FIGS. 1 to 7.

The invention also includes the case where the cables are replaced by a gear train.

FIGS. 2, 3, 4, 5 & 9 show how the device is joined to the body of the kayak by T-bolts 100.

The present invention produces a lot of speed out of a kayak with little effort. The present invention provides watercraft which are more fun to use. The device is also highly utilitarian in that it can be easily removed from one watercraft and placed in another. The stability of the kayak is also improved with the flappers in the water.

It is usually not necessary to achieve more than one side-to-side cycle of the flappers through the arcuate pathway for every back and forth cycle of the pedals. When the ratio of the rotation of the flappers versus the cycle of the pedals is increased to a ratio of 3:1, the pedals move 14" while the flappers move through about 200 degrees of rotation. At this ratio, the resistance on the pedals is large and thus the cadence is low. Generally, the higher ratio permits the use of smaller flappers.

The flappers can be made in a fiberglass mold which makes a two sided fiberglass sail. The flexing and twisting characteristics are ideal. Similar sails could be vacuum formed in production. The flappers can also be made from flexible plastic or rubber. By using a flexible plastic, it is possible to eliminate the need for a separate mast. Instead, the flappers can be in the form of fins that can articulate or twist to form an angle of attack for providing forward thrust or propulsion.

The invention is defined by the following claims.

I claim:

1. A novel water craft having propulsion means extending below the water line comprising a pair of flexible flappers each adapted to oscillate through an arcuate path in a generally transverse direction with respect to the central longitudinal dimension of said watercraft, and means operatively associated with said propulsion means for applying input force to said propulsion means whereby as input force is applied said flexible flappers can twist to form an angle of attack for providing forward thrust with respect to the longitudinal dimension of the watercraft while moving in both directions along said arcuate path.

2. The water craft of claim 1 wherein the force applied to said propulsion means is human footpower and/or handpower.

3. The water craft of claim 1 wherein said flappers are adapted to simultaneously reverse direction at opposite ends of said arcuate path.

4. The water craft of claim 1 wherein each of said flappers is carried by a mast with each of said flappers being sufficiently rotatable about said mast so that the flapper produces forward thrust with respect to the longitudinal dimension of said watercraft while moving in both directions along said arcuate path.

5. The watercraft of claim 1 wherein said flexible flappers oscillate through an arcuate path in a generally transverse direction about an axis which is at or below the bottom of the watercraft.

6. The watercraft of claim 1 wherein said means for applying propulsive force includes a pair of pedals and pedal shafts operatively associated with said propulsion means.

7. The watercraft of claim 1 wherein said watercraft is a kayak.

8. The watercraft of claim 1 wherein said pair of flappers are each carried by a support which rotates about a common longitudinal shaft.

9. The watercraft of claim 1 wherein said means for applying propulsive force includes a pair of pedals and pedal shafts operatively associated with said propulsion means, and further wherein said pair of flappers are each carried by a support which rotate about a common longitudinal shaft.

10. The watercraft of claim 9 wherein said pair of pedals and pedal shafts are carried by a common transverse shaft.

11. The watercraft of claim 9 wherein the means for applying propulsive force includes cables or a combination of cable with chain and sprocket.

12. A novel device adapted to be placed in a watercraft, said device including propulsion means extending below the water line comprising a pair of flexible flappers each adapted to oscillate through an arcuate path in a generally transverse direction with respect to the central longitudinal dimension of said watercraft, and means operatively associated with said propulsion means for applying input force to said propulsion means whereby as input force is applied said flexible flappers that can twist to form an angle of attack for providing forward thrust with respect to the longitudinal dimension of the watercraft while moving in both directions along said arcuate path.

13. The device of claim 12 wherein the force applied to said propulsion means is human footpower and/or handpower.

14. The device of claim 12 wherein said flappers are adapted to simultaneously reverse direction at opposite ends of said arcuate path.

15. The device of claim 12 wherein each of said flappers is carried by a mast with each of said flappers being sufficiently rotatable about said mast so that the flapper produces forward thrust with respect to the longitudinal dimension of said hull while moving in both directions along said arcuate path.

16. The device of claim 12 wherein said device is adapted to be received in a watercraft such that said flexible flappers oscillate through an arcuate path in a generally transverse direction about an axis which is at or below the bottom of the watercraft.

17. The device of claim 12 wherein said means for applying propulsive force includes a pair of pedals and pedal shafts operatively associated with said propulsion means.

18. The device of claim 12 wherein said pair of flappers are each carried by a support which rotates about a common longitudinal shaft.

19. The device of claim 12 wherein said means for applying propulsive force includes a pair of pedals and pedal shafts operatively associated with said propulsion means, and further wherein said pair of flappers are each carried by a support which rotate about a common longitudinal shaft.

20. The device of claim 19 wherein said pair of pedals and pedal shafts are carried by a common transverse shaft.

21. The device of claim 19 wherein the means for applying propulsive force includes cables or a combination of cable with chain and sprocket.

* * * * *